United States Patent [19]

Nilsson et al.

[11] Patent Number: 5,034,252

[45] Date of Patent: Jul. 23, 1991

[54] OXYGEN BARRIER PROPERTIES OF PET CONTAINERS

[75] Inventors: Torsten Nilsson, Loddekopinge, Sweden; Rolando Mazzone, Asperup; Erik Frandsen, Odense S, both of Denmark

[73] Assignee: PLM AB, Malmö, Sweden

[21] Appl. No.: 501,154

[22] Filed: Mar. 28, 1990

Related U.S. Application Data

[63] Continuation of Ser. No. 217,362, Jul. 11, 1988, abandoned.

[30] Foreign Application Priority Data

Jul. 10, 1987 [SE] Sweden ..... 8702840

[51] Int. Cl.[5] ..... B65D 23/00; B24C 49/06; B29C 71/02

[52] U.S. Cl. ..... 428/35.8; 264/232; 264/234; 264/532; 428/36.6; 524/538

[58] Field of Search ..... 264/532, 232, 234; 428/35.8, 458, 36.6, 36.92, 475.2, 480; 215/1 C; 524/538

[56] References Cited

U.S. PATENT DOCUMENTS

| | | | |
|---|---|---|---|
| 3,586,514 | 6/1971 | Vigibrief | 99/171 |
| 4,048,361 | 9/1977 | Valyi | 428/483 |
| 4,104,466 | 8/1978 | Tsuchida | 252/431 C |
| 4,384,972 | 5/1973 | Nakamura | 252/188.21 |
| 4,417,021 | 11/1983 | Nakamura | 524/538 |
| 4,501,781 | 2/1985 | Kushida et al. | 428/36.6 |
| 4,524,045 | 6/1985 | Hayashi et al. | 264/532 |
| 4,567,227 | 1/1986 | Kiss | 524/538 |
| 4,631,159 | 12/1986 | Maeda et al. | 264/101 |
| 4,772,656 | 9/1988 | Tanner | 428/35.8 |

FOREIGN PATENT DOCUMENTS

| | | |
|---|---|---|
| 2410882 | 9/1974 | Fed. Rep. of Germany . |
| 1933997 | 2/1978 | Fed. Rep. of Germany . |
| 1469396 | 4/1977 | United Kingdom . |
| 0083826 | 7/1983 | United Kingdom . |
| 0092979 | 10/1983 | United Kingdom . |

*Primary Examiner*—James J. Seidleck
*Attorney, Agent, or Firm*—Ladas & Parry

[57] ABSTRACT

A container wall of stretched plastic material has high oxygen barrier properties by incorporating an activating metal into the plastic material. The plastic material is PET in admixture with a polyamide and the metal is either added to the mixture or contained in one or both of the polymers. The material is stretched and aged to produce the container wall with the high oxygen barrier properties. The metal is preferably a transition metal and can be derived from a salt, such as a halide or acetate.

19 Claims, No Drawings

OXYGEN BARRIER PROPERTIES OF PET CONTAINERS

This is a continuation of copending application Ser. No. 07/217,362, filed 07/11/88, now abandoned.

TECHNICAL FIELD

The present invention in general relates to the provision of improved barrier properties in packaging containers of plastic material in which the plastic material comprises a mixture of polyethylene terephthalate (PET) and polyamide, and in particular to a method of producing a container having high oxygen barrier properties and to a container wall forming a part of such a container.

BACKGROUND ART

Within the packaging industry, there is a progressive change towards the use of containers of plastic material. This relates to both containers for beverages, including carbonated beverages, and containers for foods. As far as foods are concerned, there is an express desire in the art also to be able to employ containers of plastic material for the storage of preserved foods. In all of these fields of application, the insufficient barrier properties of the plastic material—and in particular its insufficient capacity to prevent the passage of gases, for example oxygen, vaporized liquids such as water vapor etc. entail that the shelf-life and durability of the products stored in the containers will be far too short.

A number of proposals have been put forward in the art to solve the above problem, but, hitherto, the proposed technique has failed to meet established demands of cost in combination with barrier properties in order that containers of plastic material may successfully be employed within the above-outlined sectors. Examples of solutions proposed in the art are laminates in which two or more layers of plastic material are combined with one another and in which the material in each layer possesses properties which entail that, for instance, gas penetration, light penetration or moisture penetration are reduced. Solutions in which, for example, a metal such as aluminum is encapsulated between the plastic materials or, for instance, forms the inner surface of the container have also been suggested in the art. Such a solution is expensive and makes it difficult, if not impossible, to apply molding techniques conventionally employed in the plastic industry. Solutions in which barrier material other than metal is applied interiorly or in layers between the plastic material have further been proposed. Such solutions suffer from the drawback that they are expensive and, in addition, reduce the possibilities of recycling and reuse of the material, unless special measures are adopted in conjunction with the recovery process to remove the barrier material before the plastic material is reused.

Solutions are also known in the art in which plastic materials of different types are mixed and thereafter molded to form containers by substantially conventional methods. Thus, for example, it is previously known to produce containers of plastic material in which the plastic material consists of a mixture of PET and polyamide. By way of example the polyamide is included in a proportion of between 4 and 10% by weight, preferably at a maximum of 7% by weight. In the production of such containers the two materials are thoroughly intermixed, the thus mixed material is fed to an injection molding machine where the mixture is melted, and the molten mixture is injected to form a preform which is rapidly cooled for the formation of amorphous material, whereupon the preform, after heating, is expanded to form a container.

In the technique described in the preceding paragraph, a certain reduction of the so-called permeability coefficient for oxygen will be achieved. The permeability coefficient is employed as a measure of the permeability of the material in respect of gases. For example, for containers of pure PET of a storage volume of 33 cl, a permeability coefficient for oxygen has been registered of the order of magnitude of between 3 and 4 when the containers are manufactured employing generally applied technology. In the application of the abovedescribed technology employing a mixture of PET and polyamide in the range of proportions stated above, a slightly lower permeability coefficient is obtained which, nevertheless, is relatively high and is of the order of magnitude of between 1 and 3, depending upon the amount of admixed polyamide. In real terms, this implies a prolongation of the shelf-life of, for example, beer from approximately 8 weeks to approximately 16 weeks. Even though a prolongation of the shelf-life to 16 weeks may be of considerable importance, it is, nevertheless, of a marginal nature in many fields of application, in particular in applications within the food industry. The above-described technique of molding containers of PET with an admixture of a minor amount of polyamide has been tested repeatedly. By way of example, it might be mentioned that in five mutually independent trial series, the following results were obtained.

| Trial No. | Weight percent polyamide | Permeability Coefficient |
|---|---|---|
| 1 | 0 | 3.0 |
| 2 | 2 | 2.4 |
| 3 | 4 | 1.8 |
| 4 | 6 | 1.3 |
| 5 | 7 | 1.0 |

It will be apparent from these results that, for pure PET, the permeability coefficient was measured at 3.0, while, with an admixture of polyamide, the permeability coefficient lay in the range of between 2.4 and 1.0. These disclosed values constitute mean values for 5 different containers or cans for each admixture percentage disclosed in the Table (admixture percentage 0 included, i.e. PET with no admixture of polyamide). For pure PET, the single highest value for the permeability coefficient was 3.4. At an admixture of 2% by weight the change in the permeability coefficient in relation to pure PET is essentially negligible.

The technique for the manufacture of containers of PET and polyamide is conventional and corresponds to the recommendation issued by manufactures of raw material and adapted to suit the properties which these two material types possess.

SUMMARY OF THE INVENTION

Among the several objects of this invention may be noted the provision of a method of producing a container with a wall having high oxygen barrier properties, comprising stretching an orientable material to form a wall of the container, said orientable material comprising a mixture of PET and a polyamide in which mixture an activating metal is present which is capable of conferring high oxygen barrier properties to the material and aging the material at a determined temperature, humidity and time period to confer said high oxygen barrier properties to the wall.

Another object of this invention is a container wall comprising stretched and aged material of a mixture of PET and polyamide containing an activating metal capable of conferring high oxygen barrier properties to the material, the components of the mixture being present in respective amount so that the wall has said high oxygen barrier properties.

Other objects and features will be in part apparent and in part pointed out hereinafter.

In accordance with the present invention it has, quite surprisingly, been found that the oxygen barrier properties in terms of the permeability coefficient can be highly improved (with a factor of approximately 100 or more) e.g. for a stretched and oriented material comprising a mixture of PET and polyamide in which the activating metal is present in the mixture and aging the material under certain conditions including temperature, humidity and time to confer said properties to the wall.

The presence of the activating metal in the mixture of PET and polyamide is very critical in accordance with the invention and is a prerequisite for obtaining the highly improved oxygen barrier properties. The role of the metal will be elucidated in detail below.

The presence of the metal is achieved by either adding a metal compound or a mixture of metal compounds to the mixture of PET and polyamide or to at least one of said polymers or relying on metals present in the polymer mixture as a result of the technique employed in manufacturing (polymerizing) each polymer or both. The presence of the metal as a result of addition is, at present, the preferred embodiment. There is a broad range of metal compounds that are effective in improving the oxygen barrier properties but quite a lot of such compounds can be excluded simply because they are too expensive. Another reason for excluding some compounds is based on lack of compatibility with the polymer or polymers.

According to a preferred embodiment the metal of the metal compound is a transition metal selected from the first, the second and the third transition series of the periodic Table, i.e. iron, cobalt, nickel; ruthenium, rodium, palladium, and osmium, iridium, platinum.

According to another preferred embodiment the metal of the metal compound comprises copper, manganese and zinc.

Both aromatic and aliphatic polyamides can be used according to the invention. A preferred aromatic polyamide is a polymer formed by polymerizing metaxylylenediamine $H_2NCH_2$—m—$C_6H_4$—$CH_2NH_2$ with adipic acid $HO_2C(CH_2)_4CO_2H$, for example a product manufactured and sold by Mitsubishi Gas Chemicals, Japan, under the designation MXD6. A preferred polyamide of non-aromatic nature is nylon 6,6. According to another preferred embodiment copolymers of polyamides and other polymers are used.

The invention is based on the finding that metal complexes, in particular of transition metals, have the capacity to bond oxygen and contribute thereto by reforming molecular oxygen, and on the utilization thereof in connection with polymers.

The effect, which results in highly improved barrier properties, is called the oxygen scavenger effect or merely the scavenger effect. A prerequiste for this effect to occur is, in accordance with what is at present understood, the formation of an active metal complex, which is only possible if the polymer contains groups and/or atoms which have the capacity to coordinate to the metal ion and that the polymer chain(s) has the ability to occupy a conformation wherein the groups and/or the atoms are present in the correct positions in relation to the metal ion. Another prerequisite is of course that a metal ion, which has the capacity to form an active metal complex, is present at a location in the molecular structure where a forming of the complex is possible. Expressed in another way the ion during the formation of a metal complex "catches" or "takes care of" the oxygen thus forming a barrier against passage of oxygen. Thus, it is theorized that the key feature of the invention is the formation of a metal complex having the capacity to bond with oxygen and to coordinate to the groups and/or atoms of the polymer.

As to the amount of metal present in the mixture of PET and polyamide this amount is not critical as long as the desired effect is obtained. One skilled in the art can without difficulty determine which concentration is appropriate in each case, but in general it can be said that a range of 50–10,000 ppm (by weight), preferably 50–1000 ppm is proper. The upper limit is dictated by such factors as economy and toxicity.

As metal compounds halides, in particular chlorides, of the above transition metals are preferred.

As to the weight proportions between PET and polyamide in the mixture it may be said that an admixture of up to 10 percent by weight of polyamide renders the material brittle, which gives rise to problems in reshaping the preform into the container and insufficient mechanical strength of the final container. This insufficient strength gives rise primarily to problems in areas where the material is exposed to extreme stresses, for example in the discharge or mouth region when the container is sealed by the closing application of a metal cap. Further, the material in the container will become discolored or wholly or partly opaque or "hazed". In larger proportions of polyamide in the mixture, the material properties will deteriorate to such an extent that the containers can no longer be molded or will be become unusable for their contemplated purpose. On the other hand, the lowest concentration limit of polyamide amounts to approximately 0.5 percent by weight.

Within said broad interval the proportion of polyamide in relation to PET can be varied mainly in view of the contemplated purpose of the container in question. At present, the preferred range is 1–7 percent by weight polyamide and the most preferred range is 2–4 percent by weight.

The invention will be further described below in detail with reference to working examples and examples of preferred embodiments, especially comprising a preferred method of producing the container and the aging conditions.

DETAILED DESCRIPTION OF PREFERRED EMBODIMENTS 500 g nylon 6,6 ("Ultramid" BASF) in the form of granules were refluxed for about 24 h with 500 ml of an ethanolic (96%) solution of cobalt chloride ($CoCl_2 \times 6H_2O$) at a concentration of 0.24 g/ml. After refluxing during said time period the granules were dried and the cobalt content was determined and amounted to 7000 ppm.

The experiment was repeated but this time polymeta-xylylene adipamide was used instead of nylon 6,6. The cobalt content of the dried granules was 4500 ppm.

A mixture was prepared consisting of 98 percent by weight of PET and 2 percent by weight of the above nylon 6,6 having a cobalt content of 7000 ppm. A similar mixture was prepared consisting of 96 percent by weight PET and 4 percent by weight of the polyamide treated as described above and having a cobalt content of 4500 ppm. Prior to being mixed together the polyamide in question and PET were dried separately, the drying conditions being those recommended by the suppliers. By way of example the granules of PET and polyamide, respectively were held at a temperature in excess of approximately 90° C., viz. within the temperature range of between 100°-140° C. for a lengthy period of time, i.e. for at least 8 h, and in this instance for at least 16 h. The materials were then fed, without being exposed to ambient atmosphere, into an injection molding machine where, in accordance with conventional techniques, they were melted and a preform was injection molded from the molten material. The material was held in the compression section of the injection molding machine at a temperature within the range of between 255° and 280° C., preferably within the range of between 260° and 275° C., and also in the injection nozzle generally within the same temperature range. The material in the preform was rapidly cooled so as to make the material amorphous.

The amorphous preform was subsequently re-shaped into a container. In certain physical applications, this was effected in that the preform of amorphous material was expanded in the axial direction and/or in its circumferential direction into an intermediate preform which, hence, consisted of thinner material than the preform and preferably of at least monoaxially oriented material. The intermediate preform was subsequently subjected to further expansion so as to be finally shaped into the container. In other physical applications, the preform was converted into the container in a single forming stage.

In one preferred embodiment, the intermediate preform was formed according to the technique described in U.S. Pat. No. 4,405,546 and GB 2 168 315. The technology described in these two patent specifications entails that the material in the walls of the preform passes, under temperature control, through a gap by means of which the material thickness is reduced at the same time as the material is stretched in the axial direction of the preform. There will hereby be obtained a monoaxial orientation of the material in the axial direction of the preform. As a rule, the gap width is selected to be sufficiently small to realize material flow in the transition zone between amorphous material and material of reduced wall thickness, i.e. oriented material. A mandrel is inserted in the thus formed intermediate preform, the circumference of the mandrel in its cross-section being greater than that of the intermediate preform, whereby the intermediate preform, on abutment against the mandrel, is expanded in its circumferential direction. By this expansion, there will be obtained favorably close contact between the material wall in the intermediate preform and the outer defining surface of the mandrel. In experiments, the mandrel had a surface temperature in excess of 90° C., preferably exceeding 150° C., which entailed that the oriented material underwent shrinkage in the axial direction of the preform. In the experiments, it surprisingly proved possible to carry out material shrinkage within a very wide temperature range, namely between 90° and 245° C. As a result of the heat treatment, the material also obtained a thermal crystallization in addition to the crystallization which occurred through the orientation of the material. Appropriately, the expanded and axially shrunk intermediate preform was thereafter trimmed so as to form a uniform discharge opening edge, in addition to which the discharge or mouth was, when necessary, given dimensions (by reshaping) which were adapted to suit a closure or seal.

It has been surprisingly found that the low permeability coefficients are achieved if the material in the preform, in the intermediate preform and/or in the expanded intermediate preform (alternatively the container) is allowed to undergo an aging process. The reduction of the permeability coefficients will also be obtained in those cases when the aging of the material is accelerated by heat treatment. For reasons of production economy, a combination of temperature and humidity is selected which gives rapid aging of the material. In experiments, the material was kept at a temperature in the range of between 20° and 100° C. for periods of time which varied between 3 days and 10 months. The extremely low permeability coefficients were obtained at such a low admixture of polyamide as 2 percent by weight, for example on storage in an air atmosphere at approximately 50% relative humidity (RH) and at a temperature of 55° C. for 3 weeks or during storage indoors with no special control of the air humidity, at a temperature of 22° C. for 3 months. The combination of approximately 100° C. and 3 days gave a permeability coefficient of below 1. On both occasions, the air humidity was 50%. In fact, measurements made with containers formed of the mixture of PET and polyamide (2%) according to the invention and aged as just stated had permeability coefficients in respect of oxygen which have fallen below the lower limit of the registration capability of the measurement equipment which corresponded to a level of 0.05, and in subsequent experiments a level of 0.01. In general, it could be ascertained that, on storage at high temperature and during a certain period of time, lower permeability coefficients were obtained than if the material had been held at a lower temperature for an equally long period of time. Similarly, on longer storage at a certain temperature, a lower permeability coefficient was obtained than in shorter storage time at the same temperature. It has surprisingly proved that the contemplated effect, i.e. the reduction of the permeability coefficient to a certain level, is achieved for a shorter storage time in a heated state in applications in which the intermediate preform is formed and the intermediate preform is allowed to shrink in its axial direction at elevated temperature, for example by the employment of the technique described above.

In the experiments conducted, primary use was made of granulate of polyamide marketed by Mitsubishi Gas Chemicals, Japan, under the designation MXD6, and granulate of PET marketed by Eastman Kodak, U.S.A., under the designation 7352. The amount of admixed polyamide was 2%, but experiments have shown that higher porportions of polyamide give a more rapid aging, but also a deterioration in mechanical properties of the material. At a level of 10 percent by weight, these properties become so poor that the container formed according to the specific process outlined in connection with U.S. Pat. No. 4,405,546 and GB 2 168 315 is no longer suitable for use in storing, after sealing, the products disclosed in the introduction to this specification.

It is apparent from the foregoing description that a key feature of the present invention is the presence of an activating metal in the mixture of PET and polyamide and that said presence is responsible for the attainment of the high oxygen barrier properties in a container produced from said mixture. It should be emphasized that this improvement of the oxygen barrier properties is independent of whether said metal has been introduced by way of a positive step or the presence of the metal in the polymers is due to the metal catalyst added in the production of the polymers.

What is claimed is:

1. A container wall comprising stretched and aged material of a mixture of polyethylene terephthalate and polyamide, said mixture containing an activating metal forming active metal complexes having capacity to bond with oxygen for conferring high oxygen barrier properties to the material, the components of the mixture being present in respective amounts so that the wall has said high oxygen barrier properties.

2. A method for producing a container with a wall having high oxygen barrier properties, comprising stretching an orientable material to form a wall of the container, said orientable material comprising a mixture of polyethylene terephthalate and a polyamide in which in said mixture an activating metal is present which is capable of forming active metal complexes having capacity to bond with oxygen for conferring high oxygen barrier properties to the material and aging the material at a determined temperature, humidity and time period to confer said high oxygen barrier properties to the wall by the formation of said active metal complexes.

3. A method as claimed in claim 1, wherein the metal is added to said mixture of polyethylene terephthalate and polyamide.

4. A method as claimed in claim 1, wherein said metal is present in one of the polymers in said mixture.

5. A method as claimed in claim 1, wherein said metal is present in both the polymers in said mixture.

6. A method as claimed in claim 1, wherein the metal is present in an amount between 50 and 10,000 ppm.

7. A method as claimed in claim 1, wherein said polyamide is present in an amount of 0.5 to 10% by weight of polyethylene terephthalate.

8. A method as claimed in claim 1, wherein said polyamide is present in an amount of 1 to 7% by weight of polyethylene terephthalate.

9. A method as claimed in claim 1, wherein said polyamide is present in an amount of 2 to 4% by weight of polyethylene terephthalate.

10. A method as claimed in claim 1, wherein said metal is added as a metal compound.

11. A method as claimed in claim 1, wherein said metal is added as a salt.

12. A method as claimed in claim 1, wherein said metal is a transition metal.

13. A method as claimed in claim 1, wherein said metal is present as an acetate of an element selected from the group consisting of cobalt, magnesium, manganese, and mixtures thereof.

14. A method as claimed in claim 1 comprising heating said mixture of polyethylene terephthalate and polyamide for at least 10 hours at a temperature of at least 90° C. in a dry atmosphere and injection molding said mixture to produce a preform, and stretching the preform to produce the container.

15. A method as claimed in claim 14 wherein said aging is effected on the stretched preform at a temperature of about 55° C. for 3 weeks.

16. A method as claimed in claim 15 wherein said aging is effected in air at a relative humidity of 50%.

17. A method as claimed in claim 14 wherein said aging is effected on the stretched preform at a temperature of about 100° C. for 3 days.

18. A method as claimed in claim 17 wherein said aging is effected in air at a relative humidity of 50%.

19. A method as claimed in claim 1 wherein said aging of the material is effected after stretching thereof.

* * * * *